US006938787B2

(12) United States Patent
Shinozaki

(10) Patent No.: US 6,938,787 B2
(45) Date of Patent: Sep. 6, 2005

(54) SYNTHETIC-RESIN SCREW CAP

(75) Inventor: Natsuo Shinozaki, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/398,477

(22) PCT Filed: Apr. 4, 2002

(86) PCT No.: PCT/JP02/03366

§ 371 (c)(1),
(2), (4) Date: Apr. 21, 2003

(87) PCT Pub. No.: WO02/085731

PCT Pub. Date: Oct. 31, 2002

(65) Prior Publication Data

US 2004/0011757 A1 Jan. 22, 2004

(30) Foreign Application Priority Data

| | | |
|---|---|---|
| Apr. 13, 2001 | (JP) | 2001-114788 |
| Apr. 25, 2001 | (JP) | 2001-126980 |
| Feb. 27, 2002 | (JP) | 2002-051861 |
| Feb. 27, 2002 | (JP) | 2002-051862 |

(51) Int. Cl.[7] ..... B65D 39/00
(52) U.S. Cl. ..... 215/252; 222/153.02
(58) Field of Search ..... 215/252, 256, 215/253, 274, 258; 220/265, 266; 222/153.02, 153.07, 153.14, 541.5, 547

(56) References Cited

U.S. PATENT DOCUMENTS

| | | | | |
|---|---|---|---|---|
| 4,436,212 A | * | 3/1984 | Alejandro Llera | 215/252 |
| 4,501,373 A | | 2/1985 | Heinlein | |
| 4,828,127 A | * | 5/1989 | Young et al. | 215/252 |
| 5,033,632 A | * | 7/1991 | Mattia et al. | 215/252 |
| 5,273,173 A | * | 12/1993 | Debetencourt | 215/252 |
| 5,402,901 A | * | 4/1995 | Carvalheiro et al. | 215/252 |
| 5,915,579 A | * | 6/1999 | Przytulla et al. | 215/252 |

(Continued)

FOREIGN PATENT DOCUMENTS

| | | | | |
|---|---|---|---|---|
| DE | 1 955 047 | | 5/1971 | |
| FR | 1 536 459 | | 8/1968 | |
| FR | 2 775 959 | A1 | 9/1999 | |
| GB | 2 194 939 | A | 3/1988 | |
| JP | A 9-142506 | | 6/1997 | |
| JP | A 11-189253 | | 7/1999 | |
| WO | WO 93/17926 | * | 9/1993 | 215/252 |

*Primary Examiner*—Lien M. Ngo
(74) *Attorney, Agent, or Firm*—Oliff & Berridge, PLC

(57) ABSTRACT

The object of the present invention is to provide a screw cap made of a synthetic resin that always exhibits a reliable stable function of preventing unjust unsealing.

It includes: a cap main body (2A) serving as a cap section, a cylindrical wall (3A) of which is closely screwed on a bottle mouth cylinder (18) constituting a pour spout of the bottle for closely fitting thereon; and a sealing ring (11) having a second locking section (12) locked from below across a first locking section (20A) formed around the outer peripheral surface of the bottle mouth cylinder (18) and connected to the lower end of the cylindrical wall (3) through a plurality of easily breakable pieces (7), wherein a plurality of second pressing slopes (14) is disposed on the upper end of the sealing ring (11) so that the plurality of second pressing slope is closely opposed to a plurality of first pressing slopes (9) disposed on the lower end of the cylindrical wall (3) so as to slidably abut against the plurality of first pressing slope from an unscrewing direction and at a tilt angle (b) that is a larger acute angle than the lead angle (a) of a helical ridge (19A) of the bottle mouth cylinder (18), thereby forcibly depressing the sealing ring (11) by abutment between both the pressing slopes during the unscrewing operation of the cap main body.

12 Claims, 19 Drawing Sheets

U.S. PATENT DOCUMENTS 6,116,443 A * 9/2000 Parrinello ..... 215/252
D441,650 S * 5/2001 Salzburg et al. ..... D9/434
6,305,579 B1 * 10/2001 Long, Jr. ..... 222/153.06
6,308,848 B1 * 10/2001 Parrinello ..... 215/252
6,382,444 B1 * 5/2002 Nyman ..... 215/252
6,793,082 B1 * 9/2004 Long, Jr. ..... 215/252

* cited by examiner

SYNTHETIC-RESIN SCREW CAP

TECHNICAL FIELD

The present invention relates to a screw cap made of a synthetic resin with a function of preventing unjust unsealing, which is joined to a pour spout of a bottle and serves as a closable cap.

BACKGROUND ART

Related art techniques of a cap having an unjust-unsealing preventing function (pilfer-proof function) include a technique disclosed in Japanese Examined Utility Model Registration Application Publication No. 1995-12294.

This related art exhibits the pilfer-proof function in such a way that: a pour spout that is opened and closed by a hinged upper lid is formed; an inner lid made of a metal plate for covering to close the opening of a bottle mouth cylinder is joined to a lid main body detachably screwed on the bottle mouth cylinder to form a lid; a break line is formed at the lower end of a skirted wall of the lid main body; the skirted wall is divided into an upper main section and a lower pilfer-proof base section; the main section and the pilfer-proof base section are connected with a plurality of breakable ribs; and a locking protrusion is provided on the inner face of the pilfer-proof base section, which is locked from below across a ring-shaped locking jaw of the bottle mouth cylinder.

In this related art, the lid main body must be unscrewed from the bottle mouth cylinder when the inner lid is removed to unseal the bottle first; however, the rib is broken by the unscrewing of the lid main body from the bottle mouth cylinder, so that the pilfer-proof base section is separated from the main body to drop to the lower part of the bottle mouth cylinder. Accordingly, with the lid main body mounted on the bottle mouth cylinder after the inner lid has been removed, the pilfer-proof base section is apart from the mounted lid main body; thus, it can be determined that the bottle has already been unsealed at the sight of this separated state.

DISCLOSURE OF INVENTION

A first invention comprises: a cap section closely screwed with a cylindrical wall section to be fitted on a pour spout of a bottle having a helical ridge cut in the outer peripheral surface; and a sealing ring having a second locking section to be locked from below across a first locking section, on the inner peripheral surface, the first locking section being formed around the outer peripheral surface of the pour spout positioned lower than the helical ridge with the outer end positioned outside the helical ridge, and the sealing ring being integrally connected to the lower end of the cylindrical wall section of the cap section through a plurality of easily breakable pieces, wherein a plurality of second pressing slopes is disposed on the upper end of the sealing ring so that the plurality of second pressing slope is closely opposed to a plurality of first pressing slopes disposed at the lower end of the cylindrical wall section of the cap section so as to slidably abut against the plurality of first pressing slope from an unscrewing direction and at a tilt angle that is a larger acute angle than the lead angle of the helical ridge of the pour spout constructing the function of screwing the pour spout of the bottle and the cap section together.

With the cap section of the screw cap joined to the limit of joining the helical ridge provided at the pour spout of the bottle, the cap section closely seals the pour spout, and the sealing ring integrally connected to the lower end of the cylindrical wall section of the cap section through the breakable pieces locks from below its second locking section to the first locking section formed at the outer peripheral surface of the pour spout.

When the cap section is unscrewed from this state, the sealing ring cannot be moved upwards relative to the cylindrical wall section, which moves upwards, by the locking of the first locking section and the second locking section; thus, the breakable pieces are broken.

By the breaking of the breakable pieces, the sealing ring normally drops and displaces due to its own weight; however, when the sealing ring does not drop by adhering to the pour spout, the first pressing slopes of the cylindrical wall section abut against the second pressing slopes of the sealing ring at the same time as the breaking of the breakable pieces or immediately thereafter, and both the pressing slopes are brought into contact with each other at a tilt angle that is a larger acute angle than the lead angle of the helical ridge of the pour spout and the helical ridge of the cap section. Therefore, the sealing ring is forcibly pushed down by the cylindrical wall section and then surely drops owing to its own weight.

Accordingly, a reliable stable pilfer-proof function can always be exhibited.

Also, since the sealing ring can forcibly be moved downwards and displaced by the unscrewing operation itself of the cap section, the operation is reliable and simple.

A second invention with the arrangement of the synthetic-resin screw cap according to the first invention comprises: a cap main body serving as a cylindrical cap section with a top, which is closely screwed with a cylindrical wall serving as a cylindrical wall section to be fitted on a bottle mouth cylinder serving as a pour spout having a helical ridge cut in the outer peripheral surface; and a short cylindrical sealing ring having a second locking section to be locked from below across a first locking section, on the inner peripheral surface, the first locking section being formed around the outer peripheral surface of the bottle mouth cylinder positioned lower than the helical ridge with the outer end positioned outside the helical ridge, and the sealing ring being integrally connected to the lower end of the cylindrical wall of the cap main body through a plurality of easily breakable pieces, wherein a plurality of second pressing slopes is disposed on the upper end of the sealing ring so that the plurality of second pressing slope is closely opposed to a plurality of first pressing slopes disposed at the lower end of the cylindrical wall of the cap main body so as to slidably abut against the plurality of first pressing slope from an unscrewing direction and at a tilt angle that is a larger acute angle than the lead angle of the helical ridge of the bottle mouth cylinder.

With the bottle mouth cylinder itself being the pour spout and the cap main body serving as a cap section joined to the limit of screwing the helical ridge cut in the outer peripheral surface of the bottle mouth cylinder, the cap main body closely seals the bottle mouth cylinder, and the sealing ring integrally connected to the lower end of the cylindrical wall serving as the cylindrical wall section of the cap main body through the breakable pieces locks its second locking section from below to the first locking section formed at the outer peripheral surface of the bottle mouth cylinder.

When the cap main body is unscrewed from this state, the sealing ring cannot be moved upwards by the locking of the first locking section and the second locking section relative to the cap main body that moves upwards; thus, the breakable pieces are broken.

The first pressing slopes of the cylindrical wall abut against the second pressing slopes of the sealing ring at the same time as the breaking of the breakable pieces or immediately thereafter, and both the pressing slopes are brought into contact with each other at a tilt angle that is a larger acute angle than the lead angle of the helical ridge of the cap main body. Therefore, the sealing ring is forcibly pushed down by the cylindrical wall and then surely drops owing to its own weight.

A third invention with the arrangement of the synthetic-resin screw cap according to the first invention comprises: a pour-cap main body serving as a pour spout of the bottle, having a attaching cylinder fitted on and over the bottle mouth cylinder and forming a pour spout by being closely fitted thereon; and an outer cap detachably screwed on the pour-cap main body and serving as a cylindrical cap section with a top for opening and closing the pour spout of the pour-cap main body, wherein:

a first locking section is formed around the outer peripheral surface of the attaching cylinder of the pour-cap main body;

a sealing ring is integrally connected through a plurality of breakable pieces to the lower end of an outer cylinder serving as a cylindrical wall section of the outer cap to be fitted on the attaching cylinder of the pour-cap main body in a closed state, the sealing ring having a second locking section to be locked from below to the first locking section of the pour-cap main body; and a plurality of second pressing slopes is disposed on the upper end of the sealing ring so that the plurality of second pressing slope is closely opposed to a plurality of first pressing slopes disposed on the lower end of the outer cylinder of the outer cap so as to slidably abut against the plurality of first pressing slope from an unscrewing direction and at a tilt angle that is a larger acute angle than the lead angle of the helical ridge of the pour-cap main body.

The outer cap serving as a cap section screwed on the pour-cap main body serving as a pour spout of the bottle, which is fitted on the bottle mouth cylinder, closely seals the pour spout of the pour-cap main body; and the sealing ring of the outer cap fitted on the attaching cylinder of the pour-cap main body locks from below its second locking section to the first locking section formed at the outer peripheral surface of the attaching cylinder of the pour-cap main body.

When the outer cap is unscrewed from this state, the sealing ring cannot be moved upwards by the locking of the first locking section and the second locking section relative to the outer cylinder constituting the cylindrical wall section of the outer cap that moves upwards; thus, the breakable pieces are broken. The first pressing slopes of the outer cylinder abut against the second pressing slopes of the sealing ring at the same time as the breaking of the breakable pieces or immediately thereafter, and both the pressing slopes are brought into contact with each other at the lead angle of the helical ridge of the pour-cap main body, that is, at a tilt angle that is a larger acute angle than the lead angle of a portion constructing the function of screwing the pour-cap main body and the outer cap. Therefore, the sealing ring is forcibly pushed down by the outer cylinder and then surely drops owing to its own weight.

A fourth invention has an arrangement in which the cylindrical wall section includes first stopping sections in combination with the first pressing slopes, and the sealing ring includes second stopping sections so that they are closely opposed to the first stopping sections so as not to get over them from the screwing direction in combination with the second pressing slopes, in addition to the arrangement of the synthetic-resin screw cap according to the first, second, or third invention.

In this invention, the sealing ring cannot be turned relative to the cylindrical wall or the outer cylinder constituting the cylindrical wall section in an unscrewing direction because of the abutment of the second stopping sections against the first stopping sections, so that the occurrence of a problem is prevented in advance in that when the sealing ring screws the cap main body or the outer cap constituting the cap section to the bottle mouth cylinder or the pour-cap main body constituting the pour spout, the easily breakable pieces are broken.

Also, since the first pressing slopes and the second pressing slopes are provided using the first stopping sections and the second stopping sections, the pressing slopes can easily be formed.

A fifth invention has an arrangement in which one of a first combination of the first stopping sections and the first pressing slopes and a second combination of the second stopping sections and the second pressing slopes is formed into a protrusion and the other is formed into a recess into which the protrusion is inserted, in addition to the arrangement of the synthetic-resin screw cap according to the fourth invention.

The present invention has a simplified arrangement of the joining sections of the stopping sections and the pressing slopes, and a simplified opposed arrangement of both stopping sections and both pressing slopes, thus facilitating molding correspondingly.

A sixth invention has an arrangement in which each of the first combinations and the second combinations, one of which is formed into a protrusion and the other is formed into a recess, is arranged in wave form in the circumferential direction, in addition to the arrangement of the synthetic-resin screw cap according to the fifth invention.

In this invention, since the first combination formed at the lower end of the cylindrical wall or the outer cylinder constituting the cylindrical wall section and the second combination formed at the upper end of the sealing ring, which have the same opposed structure, are each arranged in wave form in the circumferential direction, the shape of the cylindrical wall section and the shape of the upper end of the sealing ring have high symmetry; thus, both the stopping sections and both the pressing slopes exhibit the aforesaid function, and improve the appearance.

A seventh invention has an arrangement in which either one of the lower surface of the cylindrical wall section and the upper surface of the sealing ring has a protrusion extending toward the other for decreasing the spacing between the cylindrical wall section and the sealing ring, in addition to the arrangement of the synthetic-resin screw cap according to the first, second, third, fourth, fifth, or sixth invention.

This invention includes a protrusion for decreasing the spacing between the cylindrical wall or the outer cylinder constituting the cylindrical wall section and the sealing ring; so that when the cap main body or the outer cap constituting the cap section is first screwed on the bottle mouth cylinder or the pour-cap main body constituting the pour spout, the protrusion abuts against the upper surface of the other sealing ring or the lower surface of the cylindrical wall section to ensure a stroke between the sealing ring and the cylindrical wall section, thereby preventing the easily breakable pieces from bending and broken because of a decreased stroke.

Even if the cap main body or the outer cap constituting the cap section bends slightly when the cap section is joined to the pour spout, the protrusion pushes the upper surface of the other sealing ring or the lower surface of the cylindrical wall section; therefore, the second locking section provided at the sealing ring of the cap section surely gets over the first locking section formed at the outer peripheral surface of the pour spout to be locked to the first locking section from below.

An eighth invention has an arrangement in which a spacing into which the end of a hard material such as a coin can be inserted is formed between the lower edge of the cylindrical wall serving as a cylindrical wall section and a neck ring provided at the lower part of the outer peripheral surface of the bottle mouth cylinder, in addition to the arrangement of the synthetic-resin screw cap according to the first, second, fourth, fifth, sixth, or seventh invention.

According to this invention, even a weak person can easily divide the sealing ring from the bottle mouth cylinder by break-opening using a familiar hard material such as a coin.

A ninth invention has an arrangement in which the width of the sealing ring is set to a value at which the lower end almost reaches the neck ring of the bottle mouth cylinder with it fitted on the bottle mouth cylinder, in addition to the arrangement of the synthetic-resin screw cap according to the first, third, fourth, fifth, sixth, or seventh invention.

According to this invention, the spacing formed between the lower edge of the attaching cylinder of the pour-cap main body and the neck ring is reduced to be minute by almost covering the neck ring with the lower end of the sealing ring; therefore, a hard material such as a coin cannot be inserted into the spacing formed between the lower edge of the attaching cylinder and the neck ring.

Accordingly, unjust division of the pour cap using a hard material can be prevented, thus improving the safety of the bottle sufficiently without failure.

A tenth invention has an arrangement in which split grooves are provided at least at the lower end of the attaching cylinder of the pour cap, and the joining strength of the pour-cap main body to the bottle mouth cylinder is set so as to be broken off by hand in the range of not turning free relative to the bottle mouth cylinder, in addition to the arrangement of the synthetic-resin screw cap according to the third, fourth, fifth, sixth, seventh, or ninth invention.

According to this invention, the joining strength of the pour-cap main body to the bottle mouth cylinder can accurately be set in an appropriate range on the basis of the number of the split grooves and the length and shape of the grooves; and when the screw cap serving as a pour cap constituted by the pour-cap main body and the outer cap is divided from the bottle mouth cylinder for collection, the bending deformation of the attaching cylinder in the direction to increase the diameter can be set in an appropriate range against the external force to divide the pour-cap main body from the bottle mouth cylinder by breaking by hand.

An eleventh invention has an arrangement in which a locking ridge is provided at the lower end of the inner peripheral surface of the attaching cylinder of the pour-cap main body fitted on the bottle mouth cylinder, which is locked across the locking circumferential ridge provided around the outer periphery of the opening of the bottle mouth cylinder, and the locking ridge of the attaching cylinder of the pour-cap main body has an intermittent circumferential ridge structure as the means for setting the joining strength of the pour-cap main body to the bottle mouth cylinder, in addition to the arrangement of the synthetic-resin screw cap according to the third, fourth, fifth, sixth, seventh, or ninth invention.

According to this invention, since the locking ridge provided at the lower end of the inner peripheral surface of the attaching cylinder of the pour-cap main body, which is locked across the locking circumferential ridge of the bottle mouth cylinder, has an intermittent circumferential ridge structure, the attaching cylinder becomes thin by the amount corresponding to the absent locking ridge, thus being easily increased in diameter. Therefore when the pour-cap main body is divided from the bottle mouth cylinder for collection, the bending deformation of the attaching cylinder in the direction to increase the diameter can be set in an appropriate range against the external force to divide the pour-cap main body by breaking by hand.

The intermittent circumferential ridge structure means a circumferential ridge structure having absent portions in opposite two positions or in plural positions with regular intervals by eliminating the locking ridge with the circumferential ridge structure.

A twelfth invention has an arrangement in which a spacing into which the end of a hard material such as a coin can be inserted is formed between the lower edge of the attaching cylinder of the pour-cap main body and the neck ring, in addition to the arrangement of the synthetic-resin screw cap according to the third, fourth, fifth, sixth, seventh, eighth, tenth, or eleventh invention.

According to this invention, even a weak person can easily divide the pour-cap main body from the bottle mouth cylinder by break-opening using a familiar hard material such as a coin.

A thirteenth invention has an arrangement in which the pour-cap main body and the outer cap are colored different, in addition to the arrangement of the synthetic-resin screw cap according to the third, fourth, fifth, sixth, seventh, ninth, tenth, eleventh, or twelfth invention.

According to this invention, since the breakable pieces are broken and the sealing ring of the outer cap moves downwards to the downward limit, the lower portion of the attaching cylinder of the different-color pour-cap main body is exposed under the outer cap to stand out clearly; therefore, the pilfer-proof function is exhibited more effectively.

A fourteenth invention has an arrangement in which the pour spout formed at the pour-cap main body is a pull-open pour spout opened by breaking and removing an unplug section having a pull ring or the like, which is divided by breakable grooves that constructs a closed loop in a sealing wall that is a bottom wall of a pour cylinder provided so as to guide the pouring of a contents liquid, in addition to the arrangement of the synthetic-resin screw cap according to the third, fourth, fifth, sixth, seventh, ninth, tenth, eleventh, twelfth, or thirteenth invention.

According to this invention, the bottle can be closely sealed reliably and firmly until the opening of the pour spout.

BEST MODE FOR CARRYING OUT THE INVENTION

Embodiments of the present invention will be described hereinafter with reference to the drawings.

First, as a first embodiment and a second embodiment, a synthetic-resin screw cap 1, shown in FIGS. 1 to 4, will be described which includes a bottle mouth cylinder 18 itself as a pour spout of a bottle, to which a cap main body 2A serving as a cap section is directly joined.

Figure 1:
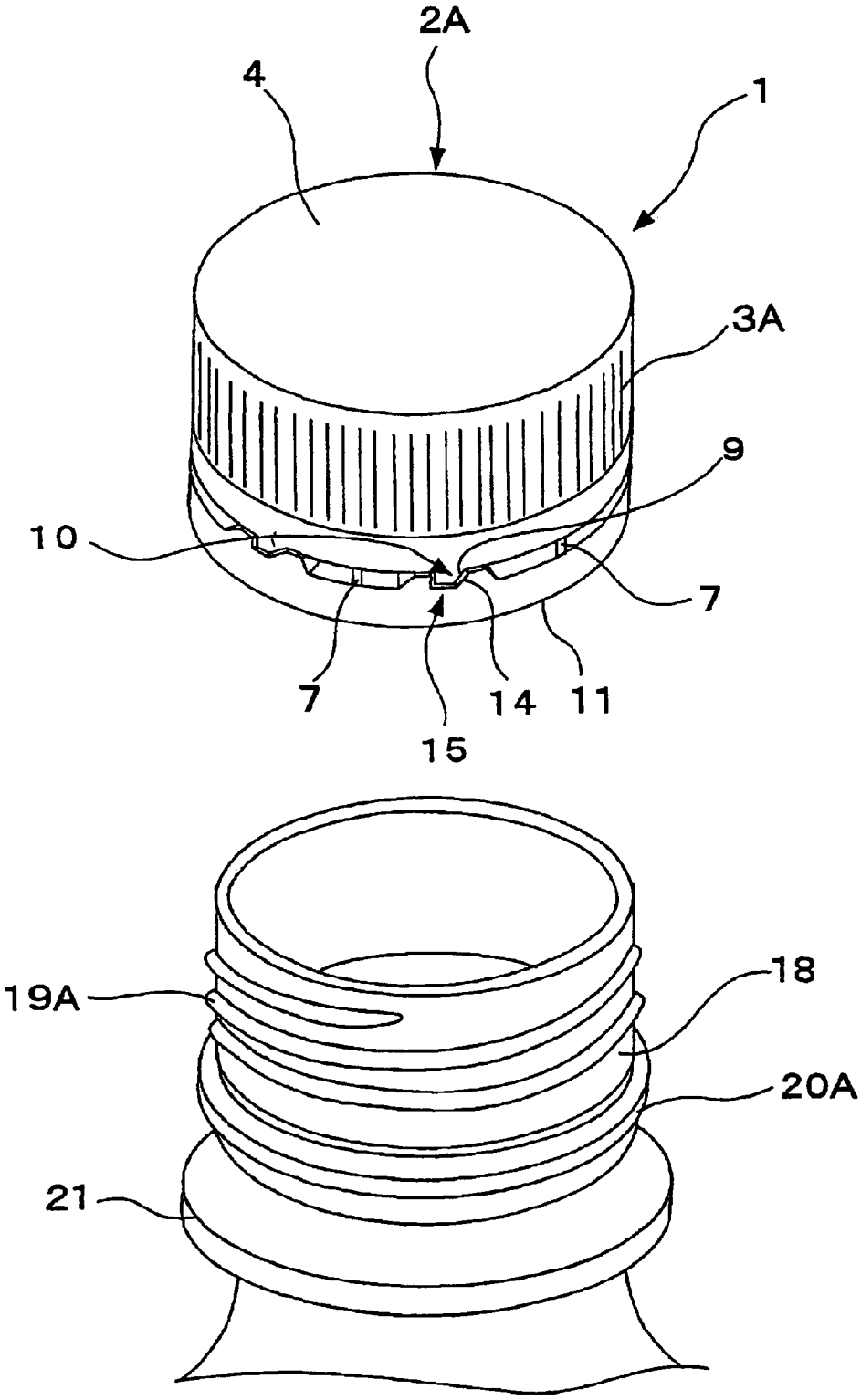
FIG. 1 is a general perspective view of a first embodiment, showing a state before a screw cap and a bottle mouth cylinder is joined.

The synthetic-resin screw cap 1 of the first embodiment, shown in FIG. 1, is a solid molding made of a polypropylene resin or a low-density polyethylene resin, and is formed such that the cap main body 2A serving as a cylindrical cap section having a top and a short cylindrical sealing ring 11 are integrally connected through a plurality of easily breakable pieces 7.

The cap main body 2A serving as a cap section is constructed in cylindrical form having a top such that the upper end of a cylindrical wall 3A serving as a cylindrical wall section, which is screwed on the bottle mouth cylinder 18 having a helical ridge 19A around the outer peripheral surface through a helical ridge 5 on the inner peripheral surface, is closed with a top plate 4 having a cylindrical plug piece 6 hung from the lower surface.

Figure 2:
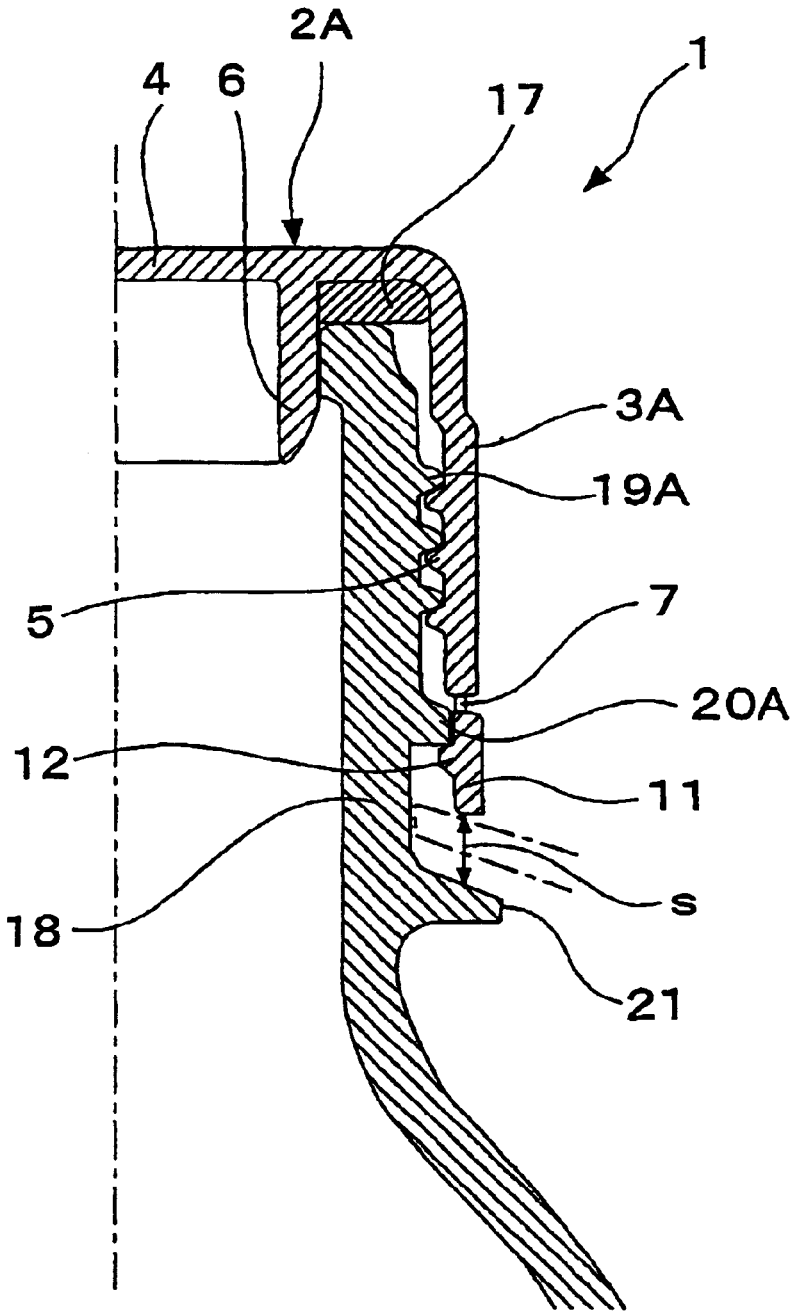
FIG. 2 is a half longitudinal sectional view of a cap main body, shown in FIG. 1, showing a state before it is unscrewed.

As shown in FIG. 2, the cylindrical plug piece 6 is closely fitted in the opening of the bottle mouth cylinder 18 directly, having a packing 17 mounted outside the cylindrical plug piece 6 and at the lower surface of the top plate 4 facing the upper end face of the bottle mouth cylinder 18. In the second embodiment of FIG. 3, since an inside plug 23 with a pour cylindrical piece 24 constituting a pour spout of the bottle is joined to the opening of the bottle mouth cylinder 18, the cylindrical plug piece 6 has the pour cylindrical piece 24 of the inside plug 23 fitted therein closely.

A sealing ring 11 connected to the lower end of the cylindrical wall 3A through easily breakable pieces 7 has a height to form a spacing s in which the end of a hard material such as a coin can be inserted between it and a neck ring 21 of the bottle mouth cylinder 18 with the cap main body 2A joined to the screw limit of the bottle mouth cylinder 18, and also has a second locking section 12 projecting from the inner peripheral surface thereof and locked from below across a first locking section 20A, the first locking section 20A being provided around the outer peripheral surface of the bottle mouth cylinder 18 positioned lower than the helical ridge 19A, with the outer end arranged outside the helical ridge 19A.

When the sealing ring 11 is separated from the bottle mouth cylinder 18, the end of a familiar hard material such as the periphery of a coin is inserted into the spacing s between the sealing ring 11 and the neck ring 21, and the sealing ring 11 is forcedly opened in the direction to increase the diameter, thus allowing easy division.

Figure 3:
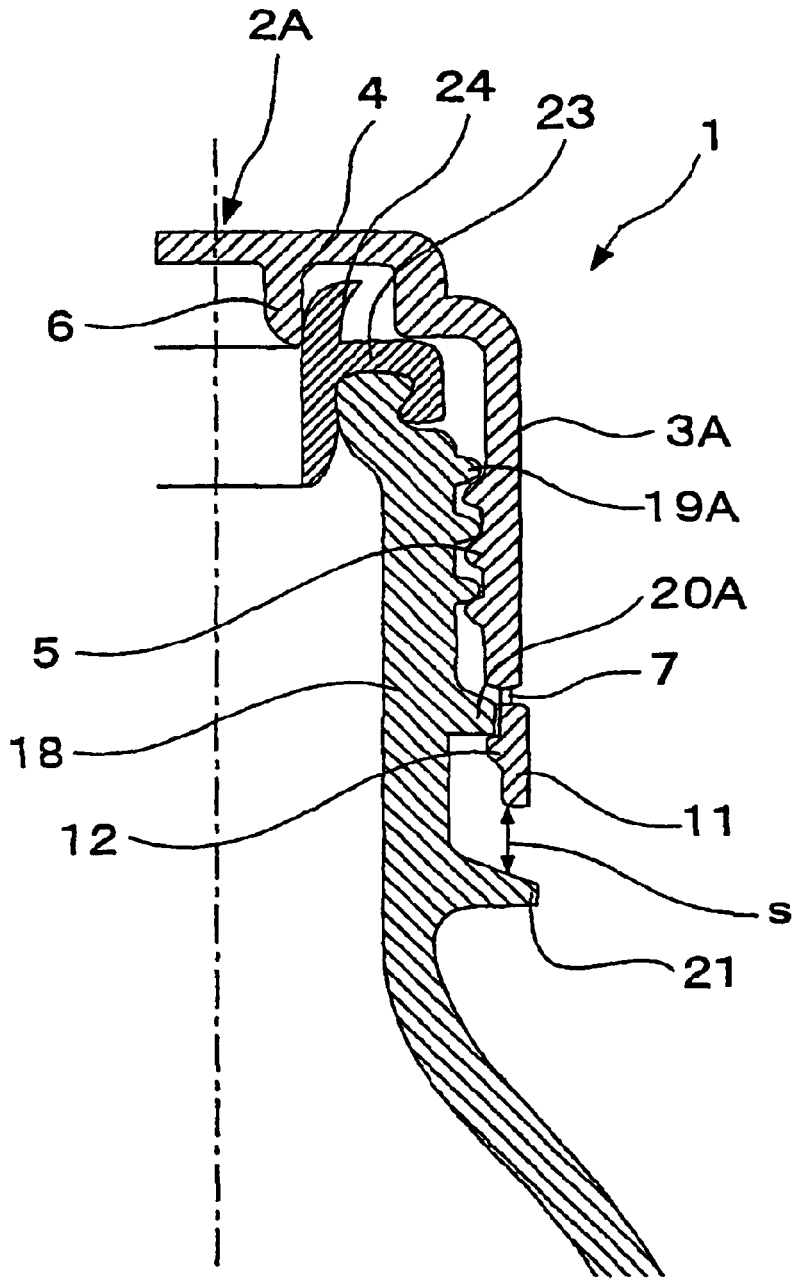
FIG. 3 is a half longitudinal sectional view of a second embodiment of a screw cap, showing a state before a cap main body is unscrewed.
Figure 4:
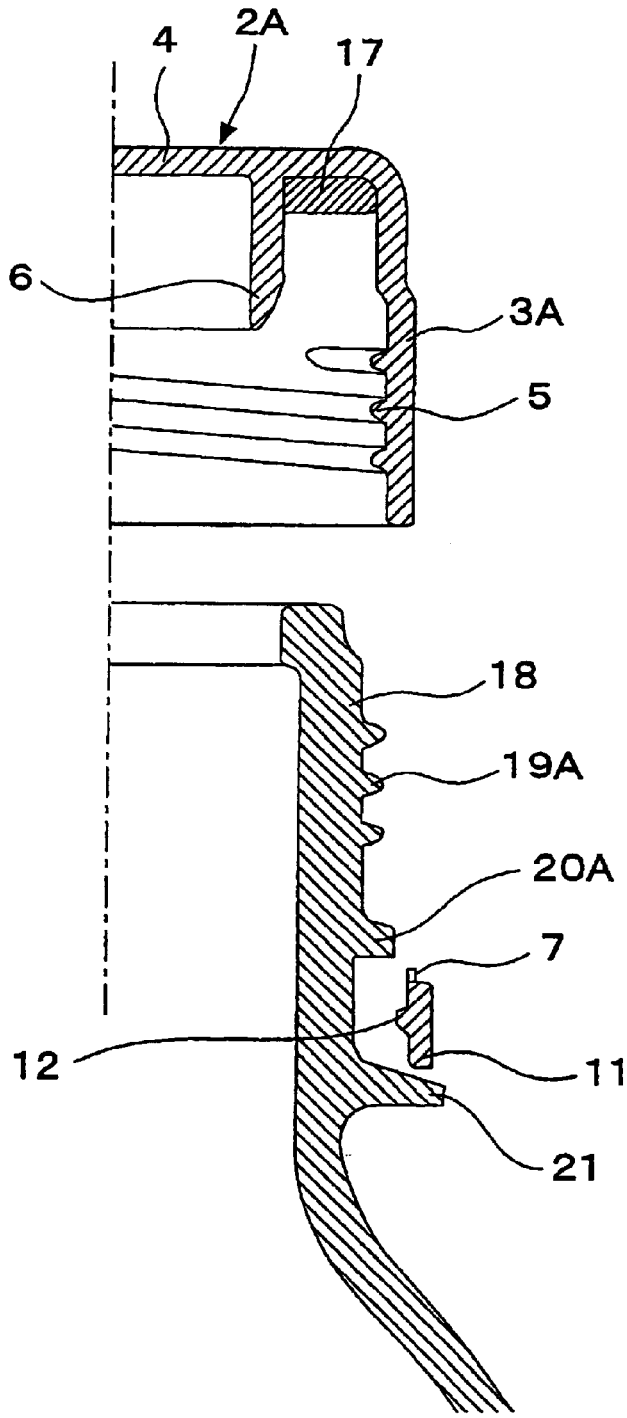
FIG. 4 is a half longitudinal sectional view of the cap main body, shown in FIG. 1, showing a state after the cap main body has been unscrewed.

Although both of the first locking section 20A and the second locking section 12 have a ridge structure in the first embodiment and the second embodiment, shown in FIGS. 2 and 3, it is not limited to that, but may be, for example, a recessed groove structure in which one engages with the other.

Figure 5:
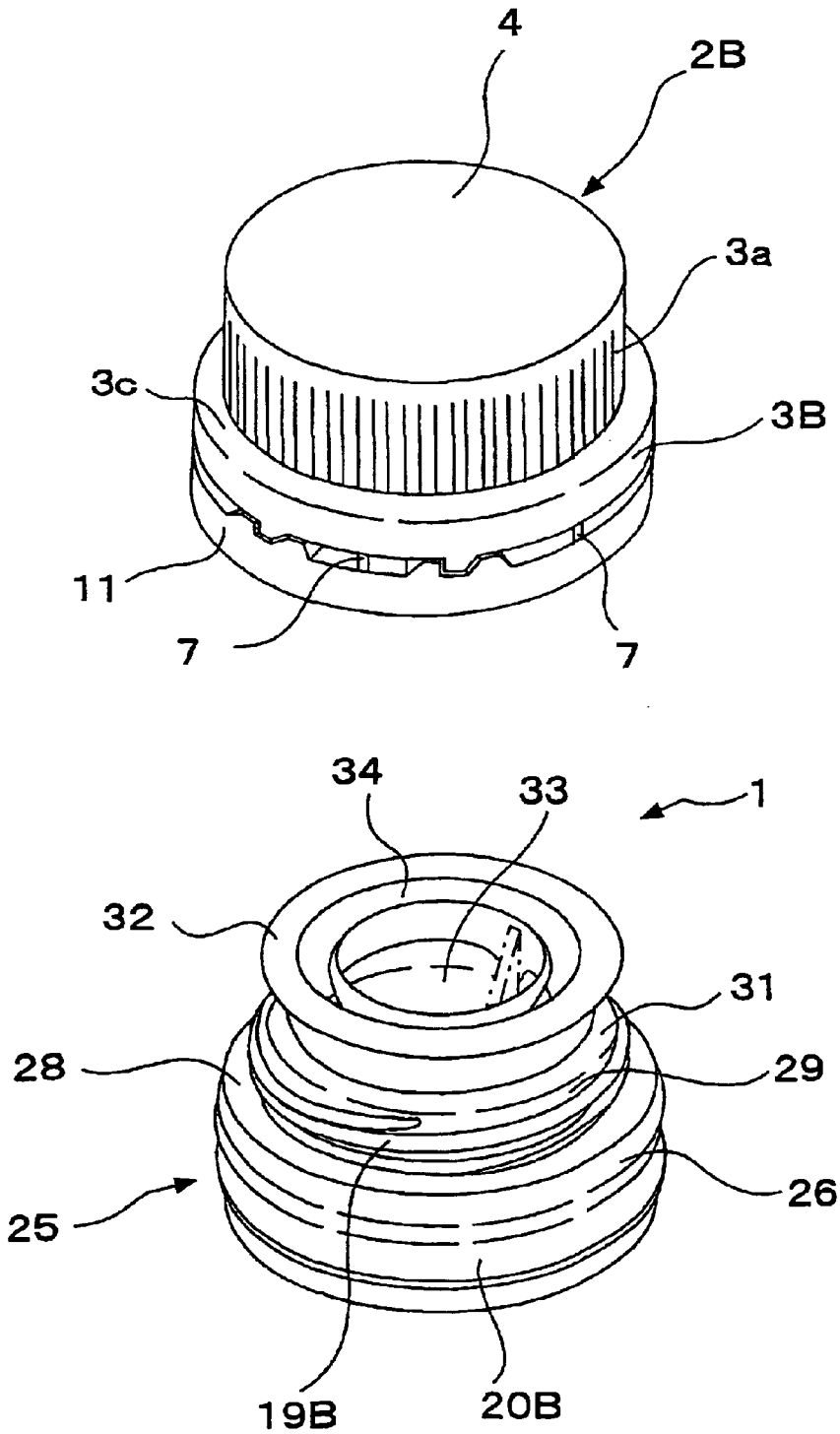
FIG. 5 is a general perspective view of a fifth embodiment of a screw cap, showing a state before a pour cap constituted by a pour-cap main body and an outer cap is joined.

Next, as a third embodiment, a synthetic-resin screw cap 1, shown in FIGS. 5 to 7, will be described which is a pour cap constituted by a pour-cap main body 25 fitted on the bottle mouth cylinder 18 serving as a pour spout of the bottle, and an outer cap 2B serving as a cap section.

The pour-cap main body 25 constituting the pour spout of the bottle is constructed such that it is fitted on the bottle mouth cylinder 18; a screw cylinder 29 having a helical ridge 19B grooved in the outer peripheral surface is arranged, through an inward-flanged top wall 28 on the upper end of a attaching cylinder 26, which is formed to a height to form a spacing into which the end of a hard material, such as the periphery of a coin, can be inserted; a pour cylinder 32 having a bottom having the upper end enlarged in diameter like a trumpet is connected to the upper end of the screw cylinder 29 through an inward flanged piece 31; and an unplug section 34 having a pull-ring or the like and divided by a breakable groove 35 formed into a closed loop is formed on a sealing wall 33 that is a bottom wall of the pour cylinder 32.

A attaching cylinder 26 fitted on the bottle mouth cylinder 18 includes a locking ridge 27 at the lower end of the inner peripheral surface for getting over and locking a locking circumferential ridge 22 provided around the outer periphery of the opening of the bottle mouth cylinder 18 to constitute a portion constructing the function of locking to the bottle mouth cylinder 18, and also forms a first locking section 20B shaped like a circumferential ridge around the outer peripheral surface of a portion facing the locking circumferential ridge 22, which is positioned on the upper outer peripheral surface adjacent to the locking ridge 27.

A sealing cylindrical piece 30 extending and hung from the screw cylinder 29 is closely fitted on the bottle mouth cylinder 18, thereby making the pour-cap main body 25 join to the bottle mouth cylinder 18 sufficiently closely.

The outer cap 2B serving as a cap section is formed such that a main cylinder 3*a* to be screwed on the screw cylinder 29 of the pour-cap main body 25 is hung from the periphery of the top plate 4 that hangs the cylindrical plug piece 6 to be closely fitted in the opening end of the pour cylinder 32 of the pour-cap main body 25; the outer cylinder 3B to be fitted on the attaching cylinder 26 via an outer flanged piece 3*c* is hung from the lower end of the main cylinder 3*a*; and the sealing ring 11 is connected to the lower end of the outer cylinder 3B via the easily breakable piece 7, the sealing ring 11 having the ridge-shaped second locking section 12, at the inner peripheral surface, to be locked from below across the first locking section 20B. The main cylinder 3*a*, the outer flanged piece 3*c*, and the outer cylinder 3B constitute a cylindrical wall section of the outer cap 2B.

Figure 6:
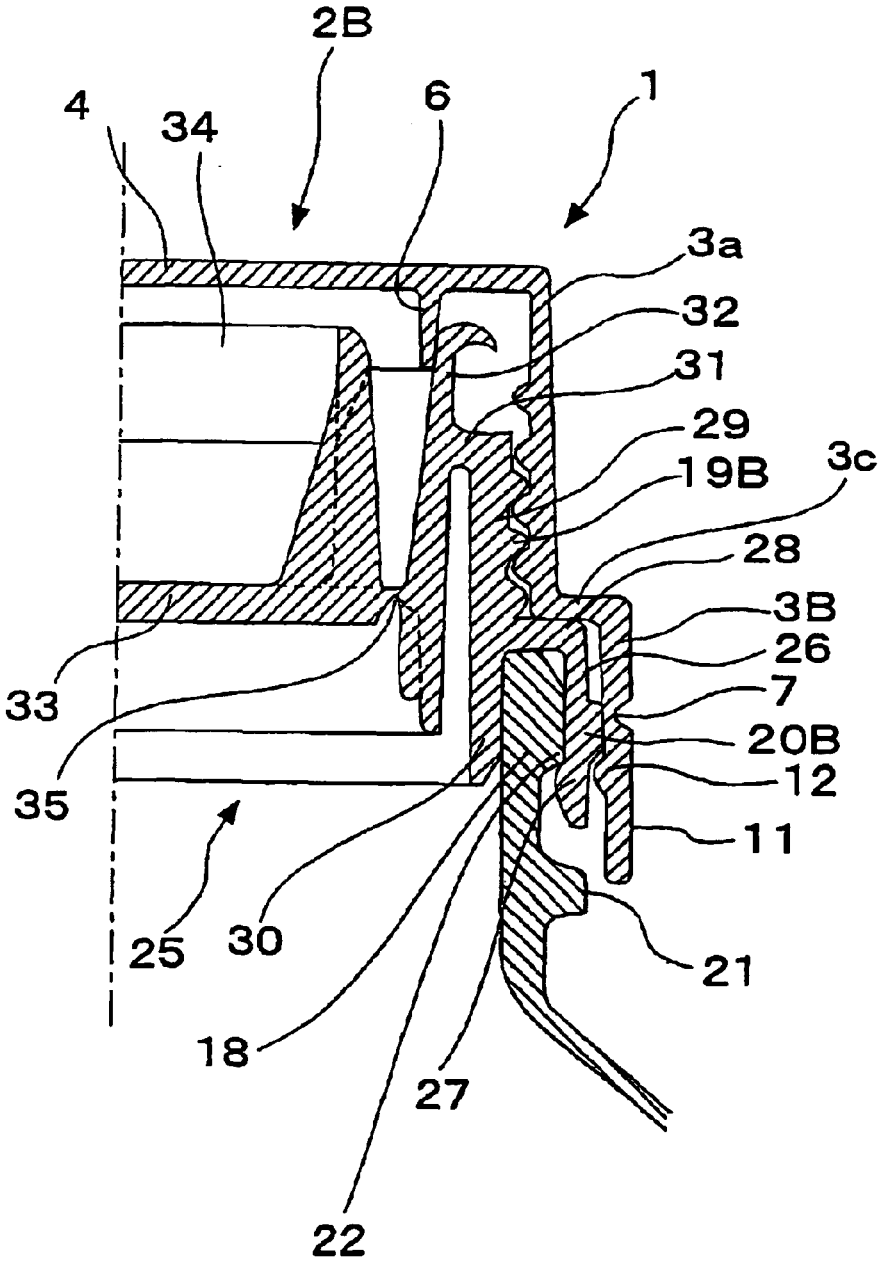
FIG. 6 is a half longitudinal sectional view of the outer cap, shown in FIG. 5, showing a state before the outer cap is unscrewed.

Since the sealing ring 11 has a width from the first locking section 20B to the neck ring 21 and an inner diameter larger than the outer diameter of the neck ring 21, the upper end thereof is substantially in contact with the first locking section 20B, and the lower end is opposed to the outer peripheral surface of the neck ring 21 in the unsealed state of FIG. 6, thus allowing it to be dropped and displaced without interference of the neck ring 21 when the breakable pieces 7 are broken.

The upper end of the sealing ring 11 provided at the lower end of the outer cap 2B is substantially in contact with the first locking section 20B of the pour-cap main body 25 constituting a pour spout, thereby preventing deformation of the attaching cylinder 26 by an increase in the diameter. Therefore, even when the attaching cylinder 26 is formed thin so as to easily be separated from the bottle mouth cylinder 18, frequent diameter enlargement and deformation of the attaching cylinder 26 can be prevented to achieve and maintain stable joining of the pour-cap main body 25 to the bottle mouth cylinder 18, and also the spacing formed between the attaching cylinder 26 and the neck ring 21 is covered, thereby disabling unjust process of directly and forcibly opening the pour-cap main body 25.

Figure 7:
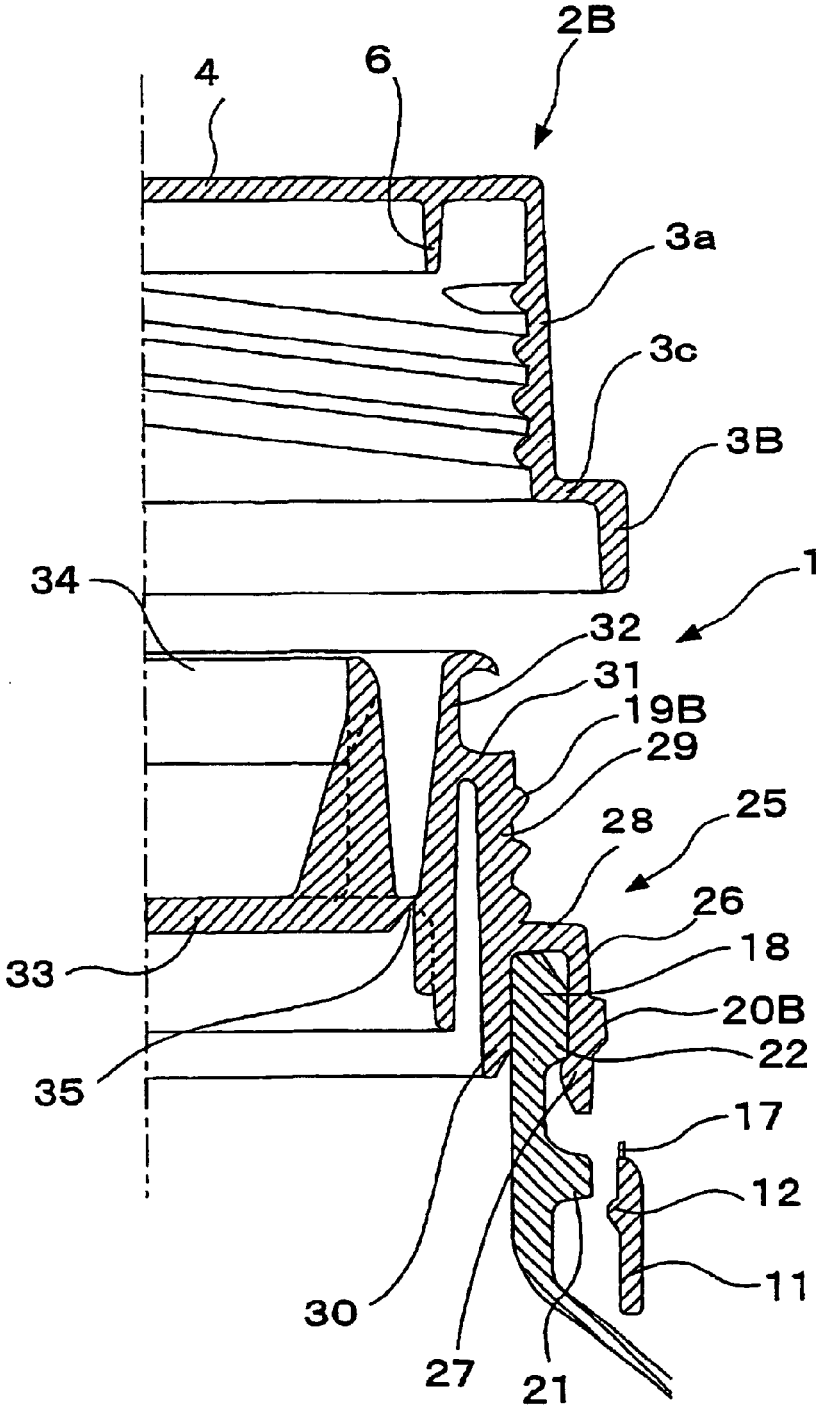
FIG. 7 is a half longitudinal sectional view of the outer cap, shown in FIG. 5, showing a state after the outer cap has been unscrewed.

Also, the minimum inner diameter of the sealing ring 11 including the second locking section 12 is set larger than the outer diameter of the neck ring 21; therefore, when the breakable pieces 7 are broken, the sealing ring 11 can be displaced downwards lower than the neck ring 21 owing to its own weight, as shown in FIG. 7, thereby preventing the occurrence of a trouble in that the second locking section 12 is caught by the neck ring 21, and so the upper end of the sealing ring 11 sheathes the lower end of the attaching cylinder 26 to disable the diameter enlargement and deformation of the attaching cylinder 26.

Figure 8:
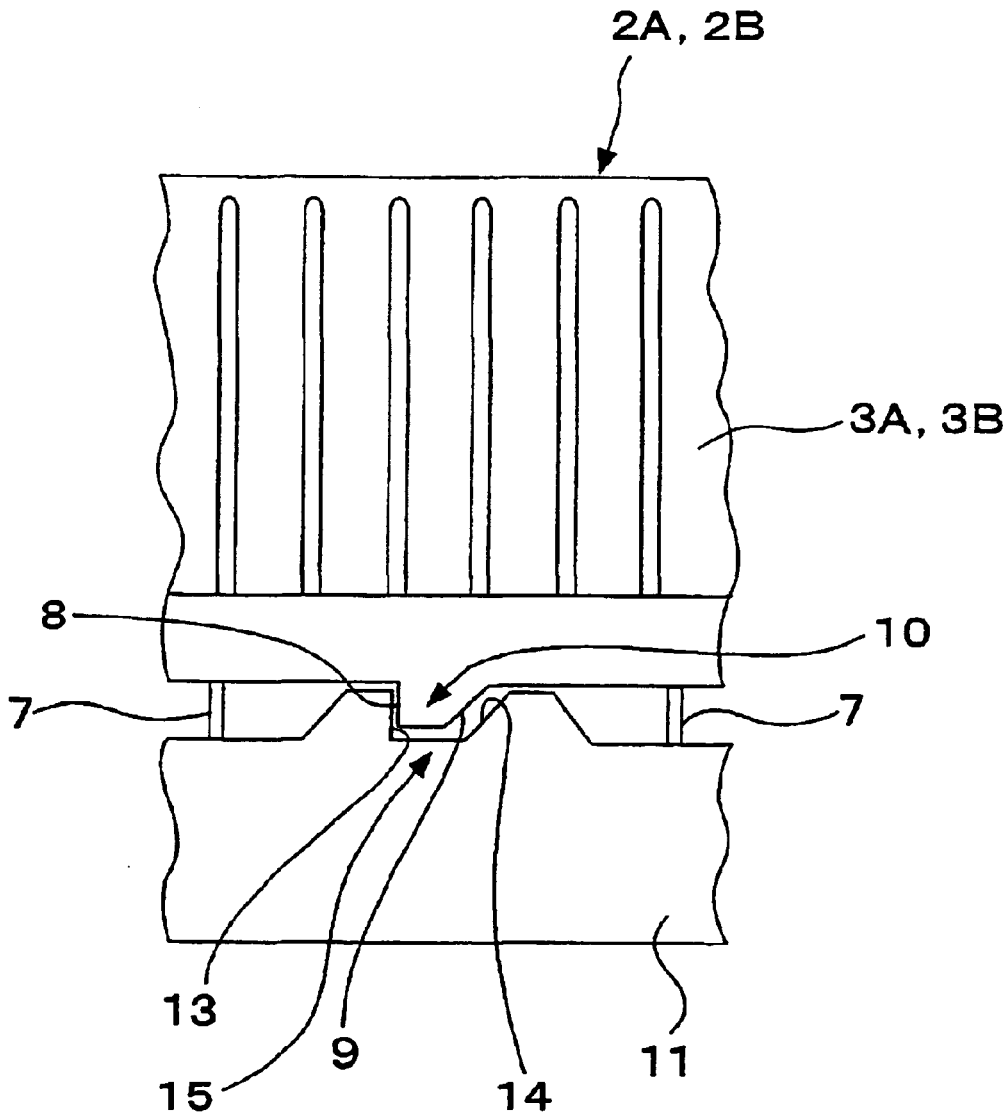
FIG. 8 is a partially enlarged front view of a first embodiment of the essential parts.

FIG. 8 shows the first embodiment of the essential parts of the present invention, which includes a plurality of first combinations of first stopping sections 8 and first pressing slopes 9 at the lower end of the cylindrical wall 3A or the outer cylinder 3B, which forms the cylindrical wall section of the cap main body 2A or the outer cap 2B serving as a cap section, respectively. A plurality of second combinations 15 of second stopping sections 13 for the first stopping sections 8 and second pressing slopes 14 for the first pressing slopes 9 is provided at the upper end of the sealing ring 11. In FIG. 8, one of the first combinations 10 is formed into a protrusion; on the other hand, one of the second combinations 15 is formed into a recessed shape between two protrusions.

Figure 9:
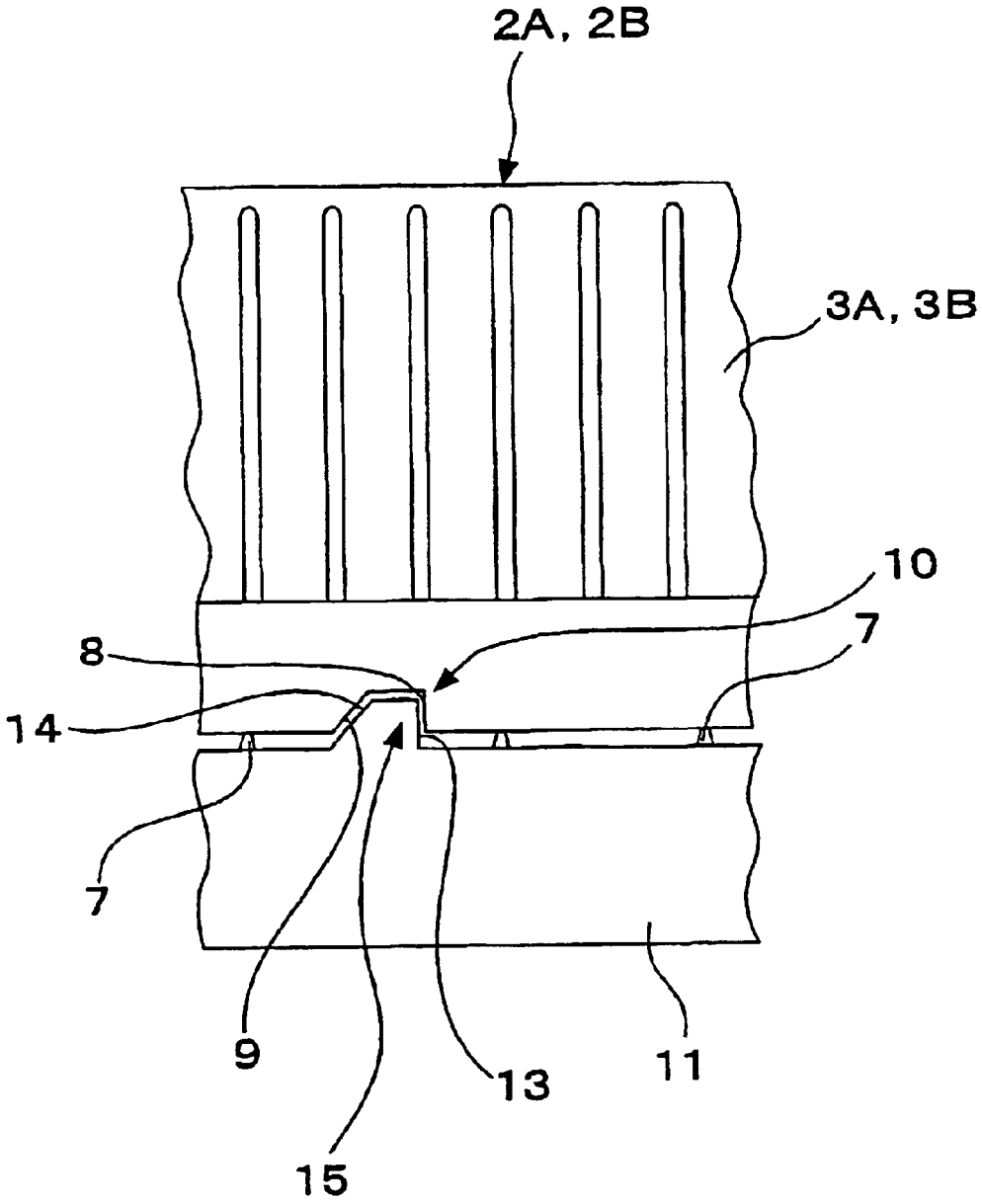
FIG. 9 is a partially enlarged front view of a second embodiment of the essential parts.

In the second embodiment of the essential parts, shown in FIG. 9, one of the first combinations 10 is formed into a recessed shape; on the other hand, one of the second combinations 15 is formed into a protrusion.

Figure 10:
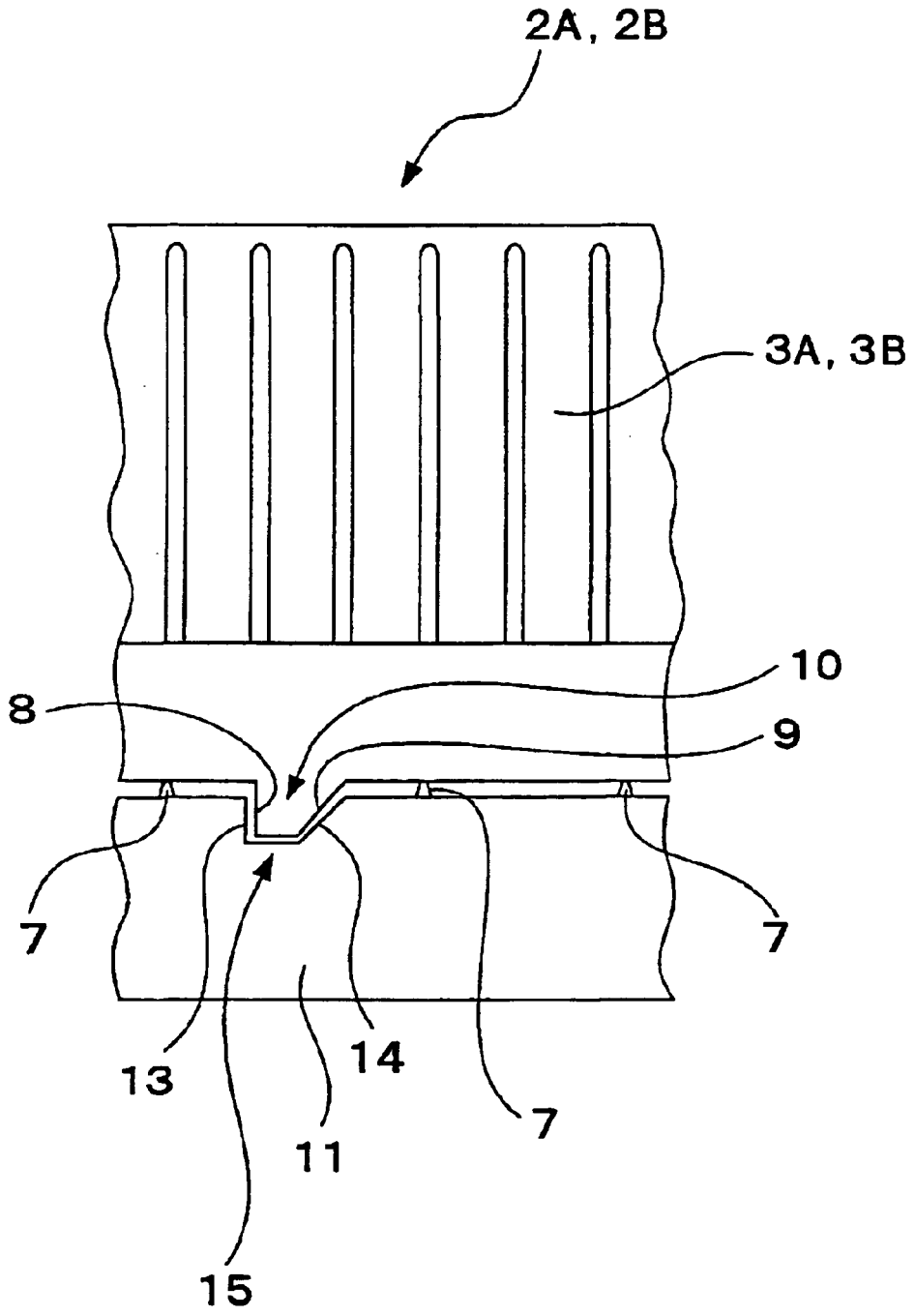
FIG. 10 is a partially enlarged front view of a third embodiment of the essential parts.

In the third embodiment of the essential parts of the present invention, shown in FIG. 10, one of the first combinations 10 is formed into a protrusion; on the other hand, one of the second combinations 15 opposite thereto is formed into a recessed shape, contrarily to the second embodiment of the essential parts shown in FIG. 9.

In the first embodiment of the essential parts, shown in FIG. 8, a relatively large spacing is formed between the cylindrical wall 3A or the outer cylinder 3B serving as a cylindrical wall section and the sealing ring 11, thus allowing decreasing the amount of a synthetic resin material required for molding the cap main body 2A or the outer cap 2B correspondingly. On the other hand, in the case of the second and third embodiments of the essential parts, shown in FIGS. 9 and 10, the easily breakable pieces 7 can be formed short, thus facilitating molding correspondingly.

The first stopping sections 8 and the second stopping sections 13 disable the rotating displacement of the sealing ring 11 in the unscrew direction relative to the cap main body 2A or the outer cap 2B by the mutual abutment to integrally rotate them in the screwing direction when the cap main body 2A or the outer cap 2B serving as a cap section is first screwed on the bottle mouth cylinder 18 or the pour-cap main body 25 serving as a pour spout of the bottle, thereby allowing the second locking section 12 to forcibly get over the first locking section 20A or the first locking section 20B.

Figure 11:
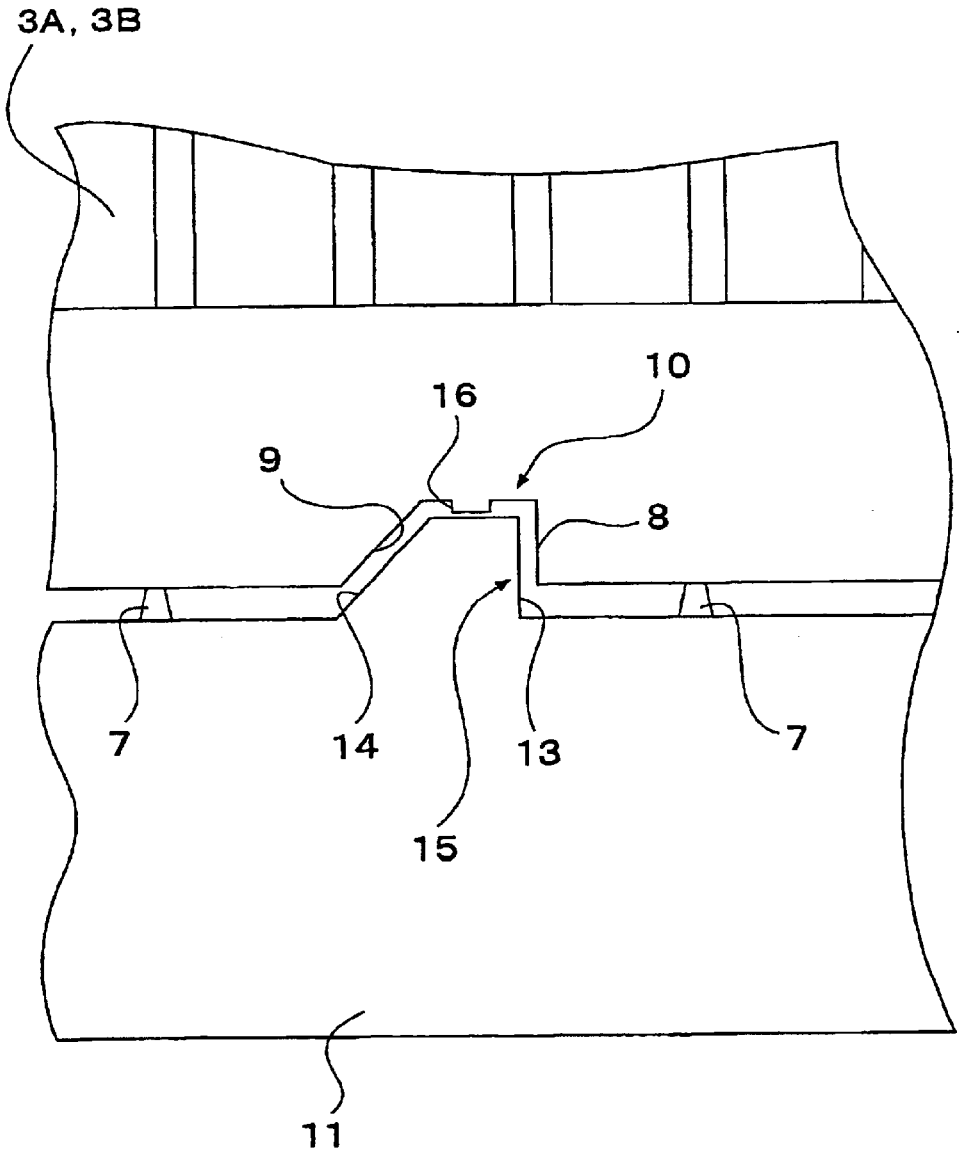
FIG. 11 is a partially enlarged front view of a fourth embodiment of the essential parts.

In a fourth embodiment of the essential parts of the present invention, shown in FIG. 11, a protrusion 16 is provided at the bottom of the first combinations 10 that is the lower surface of the cylindrical wall 3A or the outer cylinder 3B so as to face the upper surface of the sealing ring 11, for decreasing the spacing between the cylindrical wall 3A or the outer cylinder 3B and the sealing ring 11. The protrusion 16 abuts against the upper surface of the sealing ring 11 when the cap main body 2A or the outer cap 2B is first screwed on the bottle mouth cylinder 18 or the pour-cap main body 25 to ensure a stroke between the cylindrical wall 3A or the outer cylinder 3B and the sealing ring 11, thereby preventing the easily breakable pieces 7 from bending to be broken because of a decrease in the stroke.

Even if the cap main body 2A or the outer cap 2B bends slightly when the cap main body 2A or the outer cap 2B is screwed on the bottle mouth cylinder 18 or the pour-cap main body 25, the protrusion 16 presses the upper surface of the sealing ring 11, and the second locking section 12 gets over the first locking section 20A or the first locking section 20B without fail to lock the first locking section 20A or the first locking section 20B from below.

Figure 12:
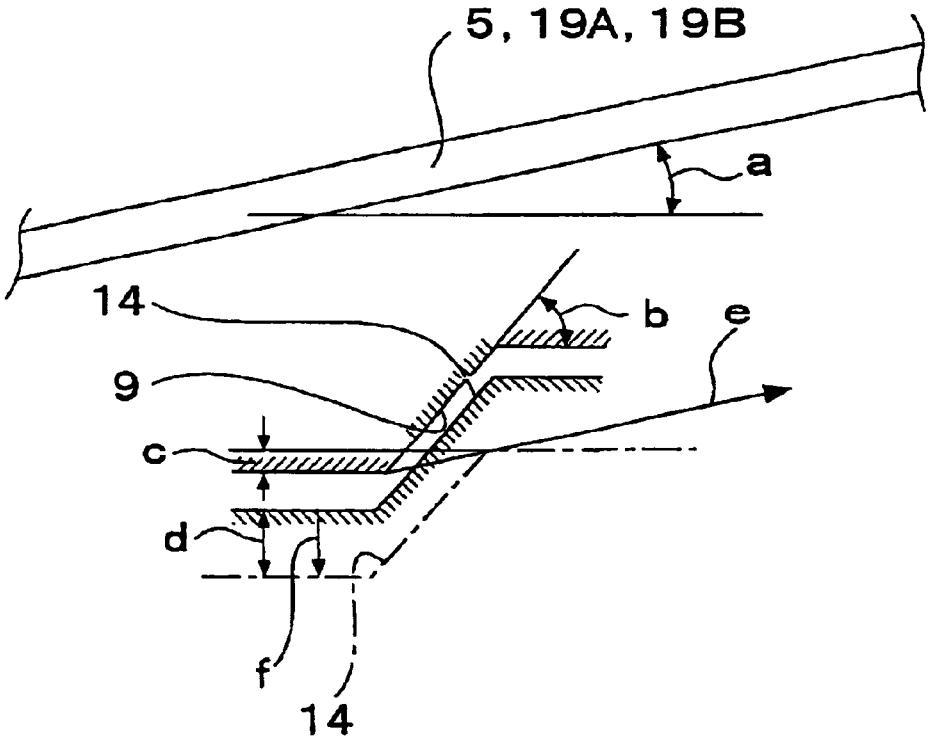
FIG. 12 is an explanatory view for describing the operation.

The first pressing slopes 9 and the second pressing slopes 14 (hereinafter, refer to FIG. 12) are brought into contact with each other at a tilt angle b that is an acute angle larger than the lead angle a of the helical ridge 5 and the helical ridge 19A or the helical ridge 19B when the screw cap 1 is first turned in the unscrew direction. Accordingly, when the first pressing slopes 9 move in the direction of e along the lead angle a in the turning range of the screw cap 1 where the abutment of both the pressing slopes is completed (the breakable pieces 7 have been broken at the start of the turning range), the second pressing slopes 14 are pushed down to move downwards in the direction of f.

In other words, the cap main body 2A or the outer cap 2B moves upwards by the distance c along the lead angle a; on the other hand, the sealing ring 11 cannot move upwards by the locking of the second locking section 12 to the first locking section 20A or the first locking section 20B. Therefore, the sealing ring 11, which cannot turn with the cap main body 2A or the outer cap 2B, is pushed down relative to the cap main body 2A or the outer cap 2B by a distance d larger than the distance c along the tilt angle b.

As described above, the sealing ring 11 is forcedly pushed down by the distance d from the cap main body 2A or the outer cap 2B. Therefore, even if the sealing ring 11 is adhered due to damp or the like to the first locking section 20A of the bottle mouth cylinder 18 or the first locking section 20B of the pour-cap main body 25 in the position where the second locking section 12 is locked to the first locking section 20A or the first locking section 20B, the sealing ring 11 is surely separated from the first locking section 20A or the first locking section 20B, and moves downwards owing to its own weight.

Figure 13:
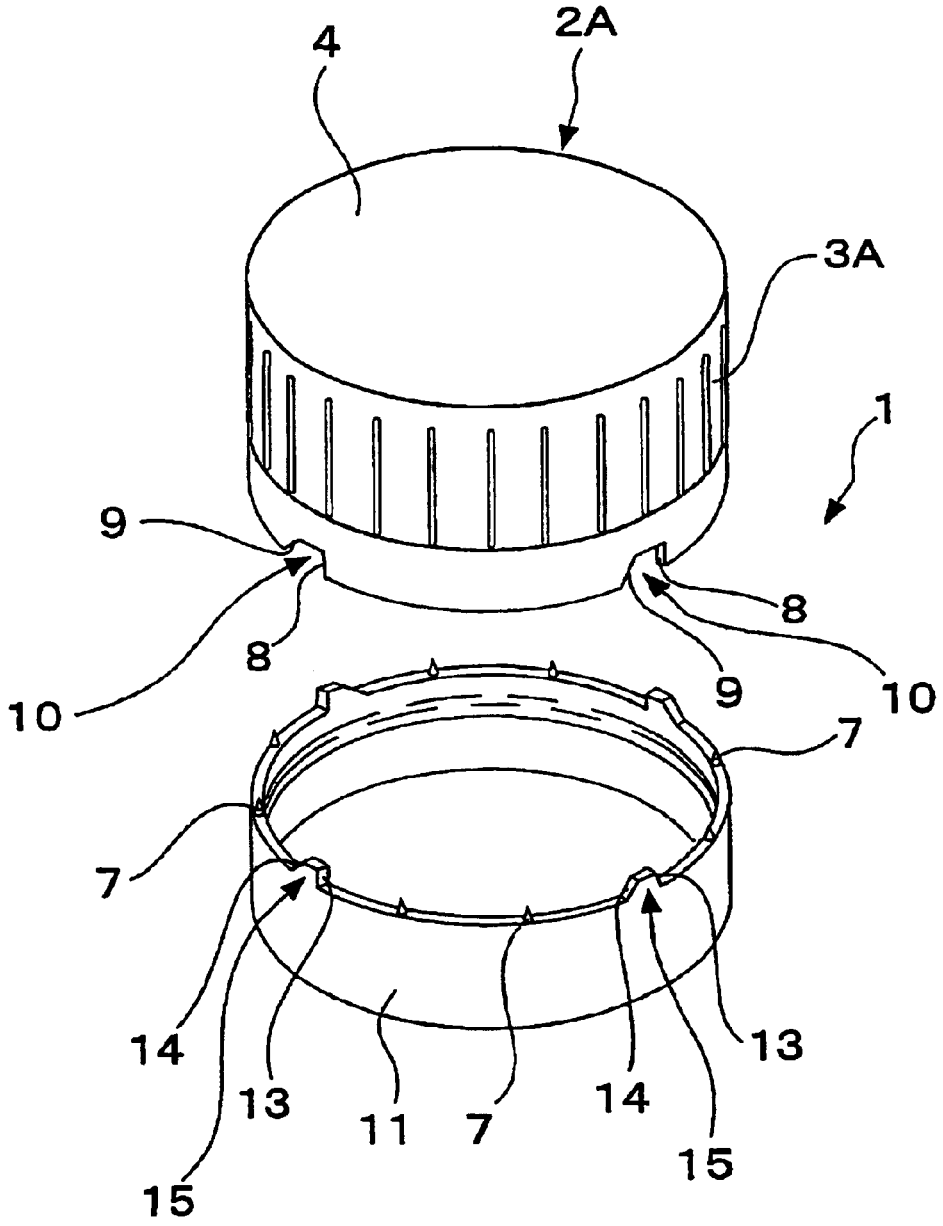
FIG. 13 is a general perspective view of the fourth embodiment of the screw cap with a cap main body divided.
Figure 14:
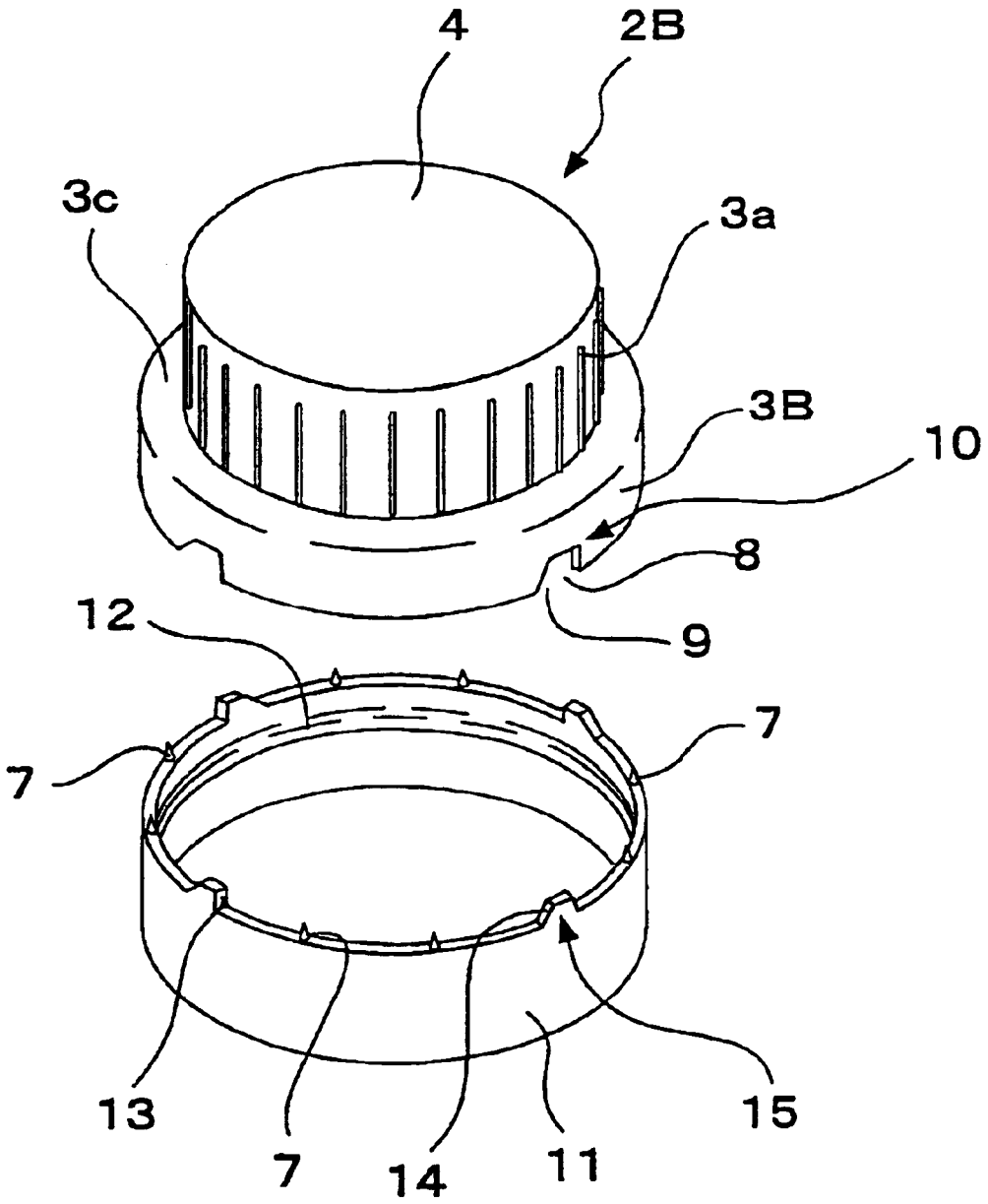
FIG. 14 is a general perspective view of a fifth embodiment of a screw cap with an outer cap divided.

For the first combinations 10 of the first stopping sections 8 and the first pressing slopes 9 and the second combinations 15 of the second stopping sections 13 and the second pressing slopes 14, it is easiest to provide a plurality of ones having the same structure at-intervals along the circumference, as in the fourth embodiment of the screw cap of FIG. 13 or the fifth embodiment of the screw cap of FIG. 14.

Figure 15:
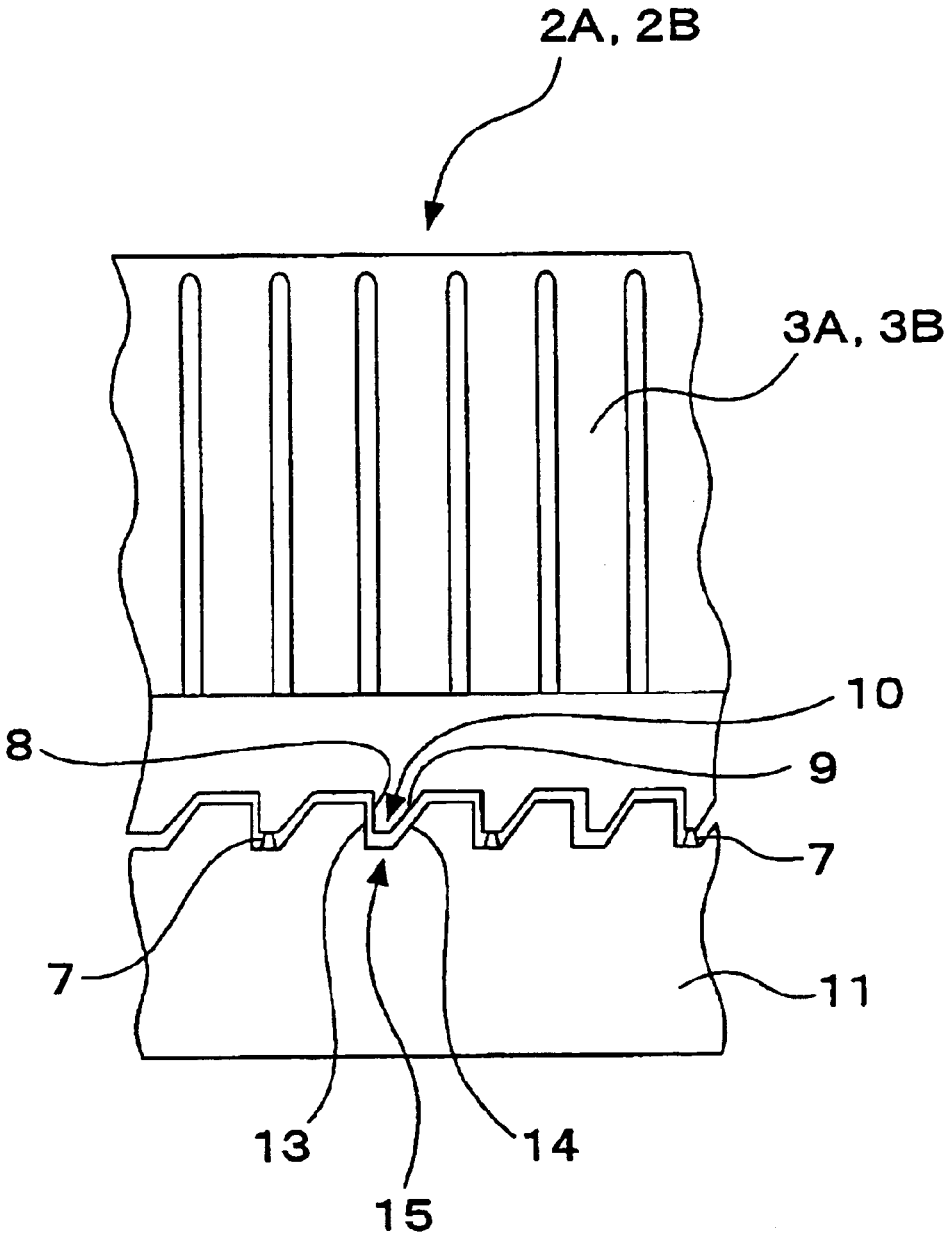
FIG. 15 is a partially enlarged front view of the fifth embodiment of the essential parts.

Also, as in the fifth embodiment of the essential parts of the present invention, shown in FIG. 15, when an opposed pair of first combinations 10 and 15 is arranged in the form of wave in the circumferential direction, the shape of the lower end of the cylindrical wall 3A or the outer cylinder 3B and the shape of the upper end of the sealing ring 11 have high symmetry, thus improving the appearance and the design.

Figure 16:
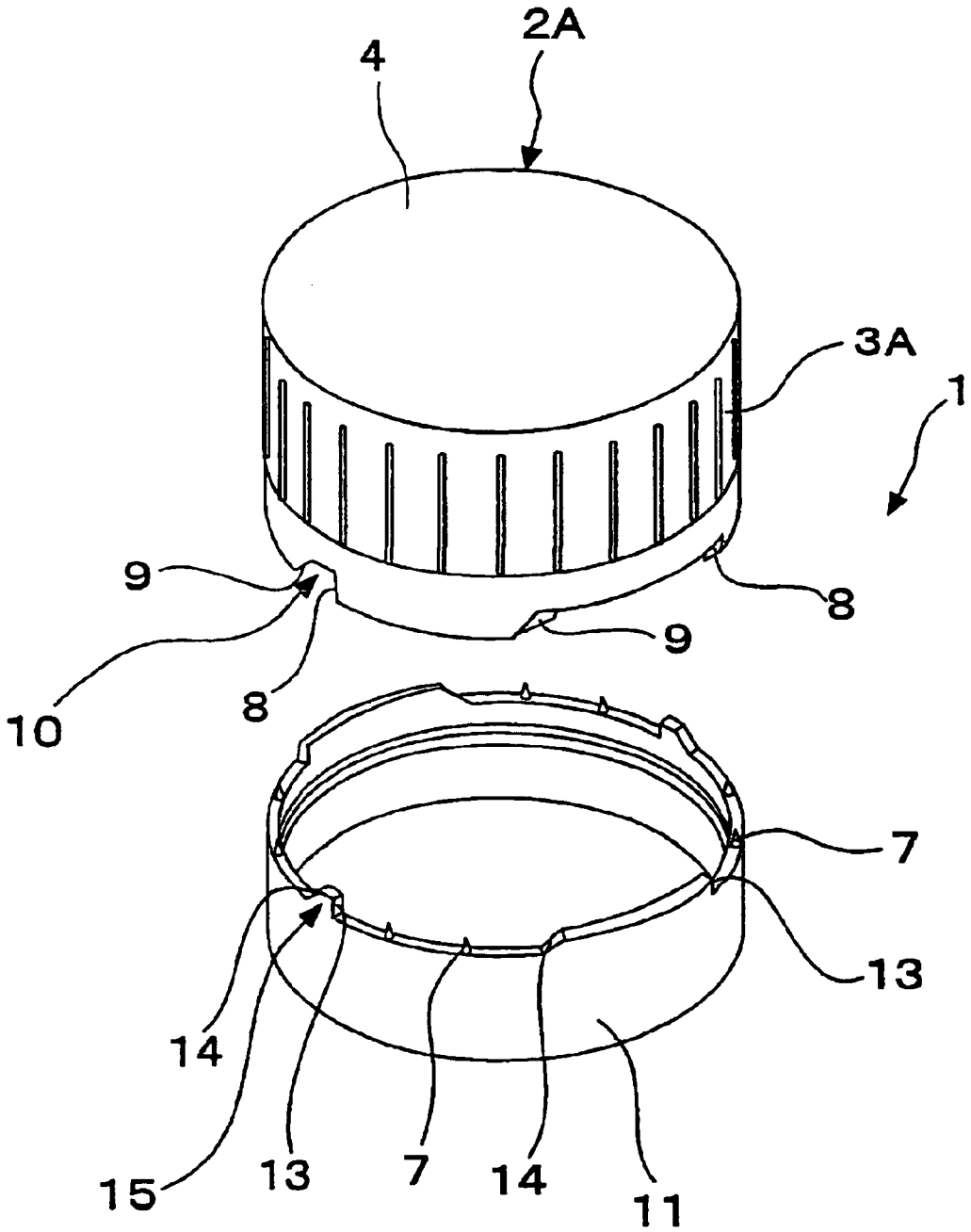
FIG. 16 is a general perspective view of a sixth embodiment of a screw cap with a cap main body divided.
Figure 17:
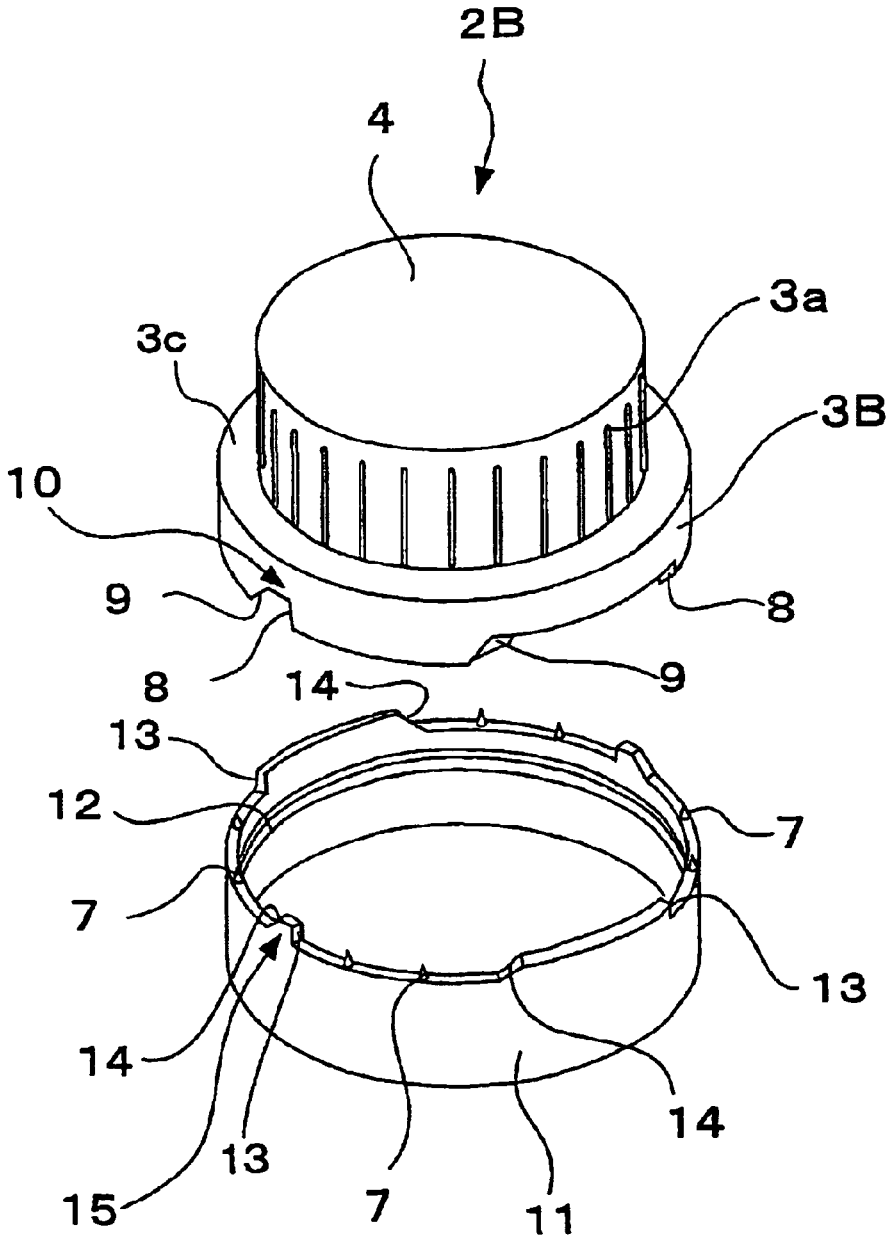
FIG. 17 is a general perspective view of a seventh embodiment of a screw cap with an outer cap divided.

On the other hand, as in a sixth embodiment of a screw cap of FIG. 16 or a seventh embodiment of a screw cap of FIG. 17, a pair of opposed combinations is formed of a combination of a protrusion that is slightly long in the circumferential direction and a recessed portion, so that a cut taper for a separate die can be formed at the circumferentially long joined portion, thereby allowing constructing a cavity mold of a mold assembly for molding the cap main body 2A and the outer cap 2B with a simple split mold without the requirement for a slide core.

When the screw cap constituted by the pour-cap main body 25 and the outer cap 2B is divided from the bottle mouth cylinder 18, the pour-cap main body 25 may be forcedly broken off with the outer cap 2B screwed thereon; however, the screw cap 1 that is a pour cap can easily be divided by inserting the end of a familiar hard material such as the edge of a coin into the spacing between the attaching cylinder 26 and the neck ring 21.

Figure 18:
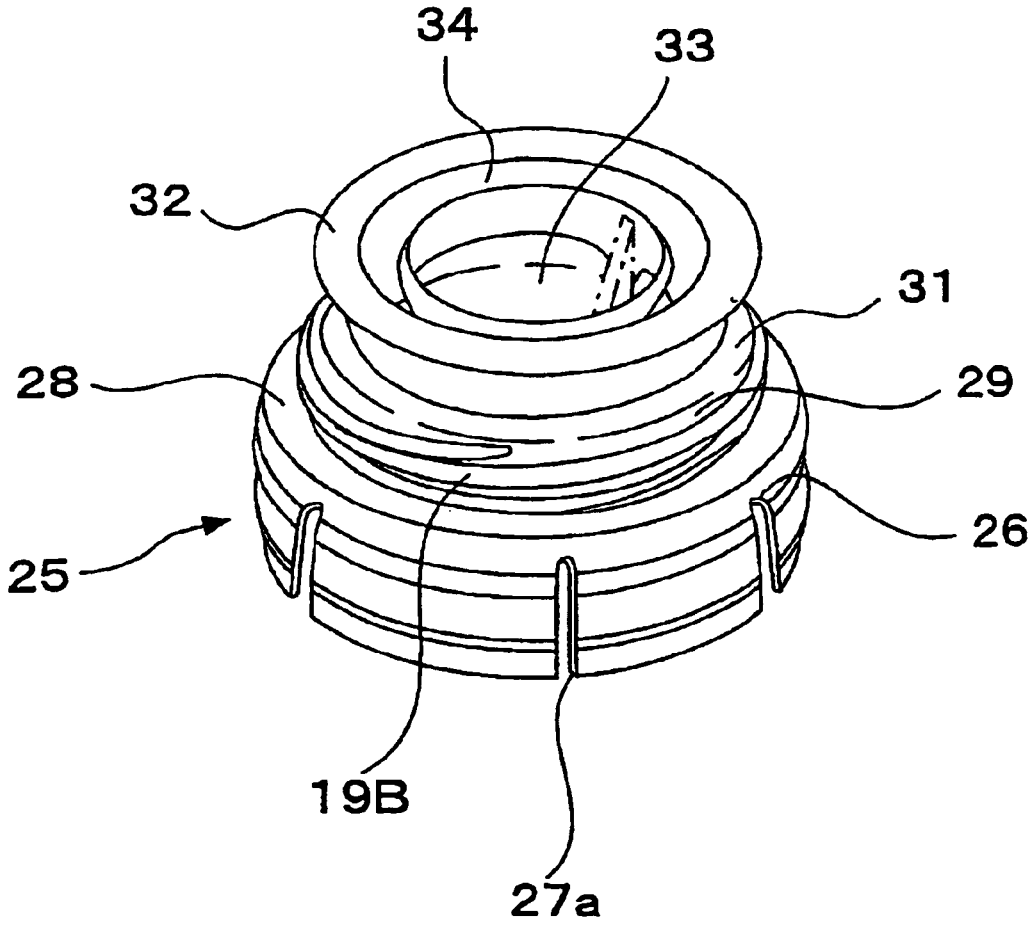
FIG. 18 is a general perspective view of an eighth embodiment of a screw cap, showing a pour-cap main body.

Also, as in the pour-cap main body 25 of an eighth embodiment of the screw cap, shown in FIG. 18, split grooves 27*a* are provided at the lower end of the attaching cylinder 26 having the locking ridge 27; and the joining strength of the pour-cap main body 25 to the bottle mouth cylinder 18 is set so as to allow breaking-off by hand in the range of not turning free relative to the bottle mouth cylinder 18.

For the attaching cylinder 26, the split grooves 27*a* are increased in diameter by the action of the breaking-off by hand, so that the attaching cylinder 26 bends to be deformed sufficiently; therefore, even a weak person can smoothly divide by breaking off the bottle mouth cylinder 18 of the screw cap 1 that is a pour cap constituted by the pour-cap main body 25 and the outer cap 2B.

When the split grooves 27*a* are formed, it is necessary to design not only the number but also the length, the width and so on in consideration of the structure of the whole bottle and the condition of use so that the joining strength of the pour-cap main body 25 to the bottle mouth cylinder 18 is in an appropriate range and also in a range to allow the pour-cap main body 25 to be broken off by the weak action of breaking-off.

Figure 19:
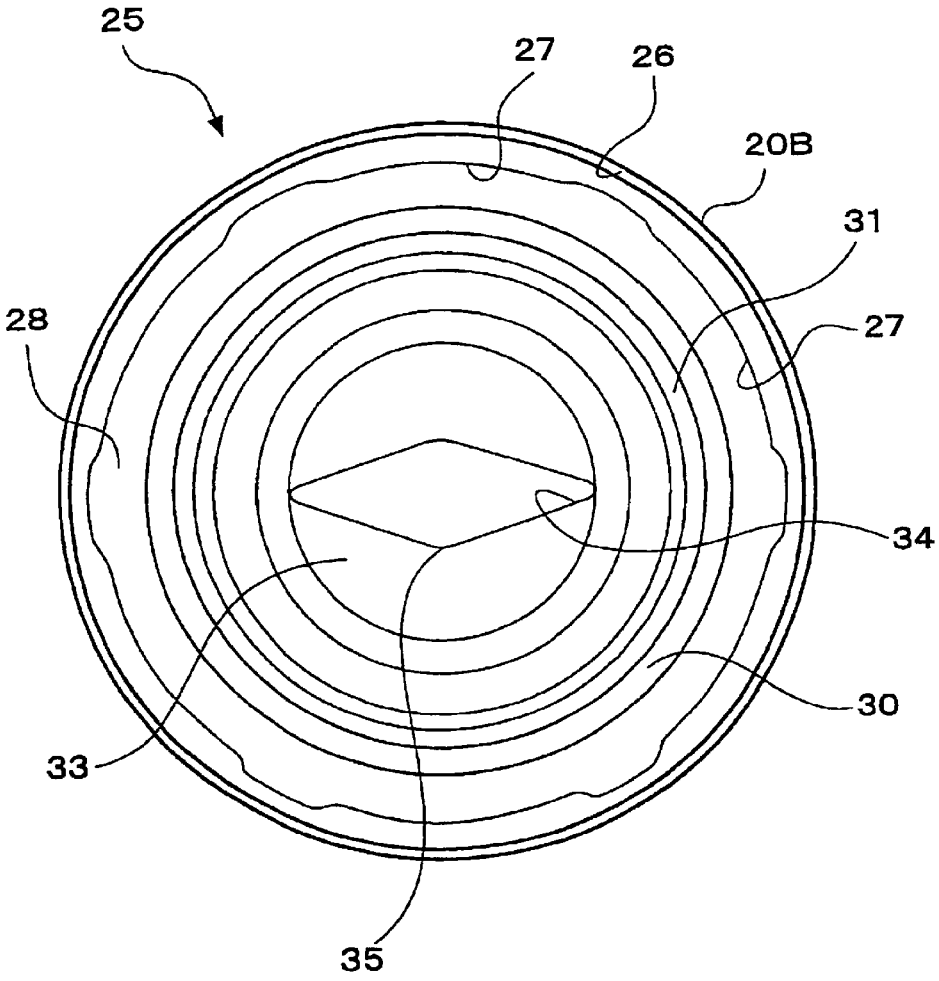
FIG. 19 is a bottom view of a ninth embodiment of a screw cap, showing a pour-cap main body.

As in the pour-cap main body 25 that is-a ninth embodiment of a screw cap, shown in FIG. 19, with a structure in which the locking ridge 27 of the attaching cylinder 26 intermittently projects around the periphery, the attaching cylinder 26 becomes thin only at portions where the locking ridge 27 is absent, thus easily increasing in diameter. Accordingly, even a weak person can smoothly break off the screw cap 1 from the bottle mouth cylinder 18.

The locking ridge 27 must have an intermittent circumferential ridge structure in which the locking ridge 27 is eliminated at two opposite portions or a plurality of portions with regular intervals in consideration of the condition of use and so on so that the joining strength of the pour-cap main body 25 to the bottle mouth cylinder 18 is in an appropriate range and also in a range to allow the pour-cap main body 25 to be broken off by the weak action of breaking-off.

In addition, it is also possible to easily divide the pour-cap main body 25 from the bottle mouth cylinder 18 by inserting a familiar hard material such as a handle of a spoon into the opening of the unplug section 34 after pulling a pullring, catching one end of the hard material in the inward-flanged sealing wall 33, and lifting up the pour-cap main body 25 by the action of lever of the hard material.

Industrial Applicability

As described above, it is a technical object of the present invention to drop and displace a portion of a pilfer-proof cap, which corresponds to a pilfer-proof base section, when a lid main body is unscrewed by breaking a portion corresponding to a rib, thus exhibiting the pilfer-proof function without fail.

What is claimed is:

1. A synthetic-resin screw cap, comprising: a pour-cap main body having an attaching cylinder that slides over and is fitted on a bottle mouth cylinder having a neck ring and forming a pour spout by being closely fitted; an outer cap serving as a cylindrical cap section, outer cylinder, and with a top for opening and closing the pour spout, wherein a first locking section is formed around an outer peripheral surface of the attaching cylinder; and a sealing ring is integrally connected to a lower end of an outer cylinder through a plurality of easily breakable pieces, the outer cylinder serving as a cylindrical wall section of the outer cap to be fitted on the attaching cylinder in a closed state, and the sealing ring having a second locking section to be slid over and locked with the first locking section of the pour cap main body, the second locking section being positioned between the first locking section and the neck ring when the cap section is screwed onto the pour spout, wherein a plurality of second pressing slopes is disposed on an upper end of the sealing ring so that the plurality of second pressing slopes is closely opposed to a plurality of first pressing slopes disposed at the lower end of the outer cylinder so as to slidably abut against the plurality of first pressing slopes from an unscrewing direction and at a tilt angle that is a larger acute angle than a lead angle of a helical ridge of the pour-cap main body.

2. A synthetic-resin screw cap according to claim 1, wherein the cylindrical wall section includes first stopping sections in combination with the first pressing slopes, and the sealing ring includes second stopping sections in combination with the second pressing slopes, the second stopping sections being closely opposed to the first stopping sections so as not to get over them from the screwing direction.

3. A synthetic-resin screw cap according to claim 2, wherein one of a first combination of the first stopping sections and the first pressing slopes and a second combination of the second stopping sections and the second pressing slopes is formed into a protrusion, and the other is formed into a recess into which the protrusion is inserted.

4. A synthetic-resin screw cap according to claim 3, wherein each of the first combinations and the second combinations, one of which is formed into a protrusion and the other is formed into a recess, is arranged in wave form in the circumferential direction.

5. A synthetic-resin screw cap according to claim 1, wherein either one of the lower end of the cylindrical wall section and the upper end of the sealing ring has a protrusion extending toward the other for decreasing the spacing between the cylindrical wall section and the sealing ring.

6. A synthetic-resin screw cap according to claim 1, wherein a spacing into which an end of a hard material can be inserted is formed between a lower edge of the cylindrical wall section and the neck ring provided at a lower part of an outer peripheral surface of the bottle mouth cylinder.

7. A synthetic-resin screw cap according to claim 1, wherein a width of the sealing ring is set to a value at which the lower end almost reaches the neck ring of the bottle mouth cylinder while being fitted on the bottle mouth cylinder.

8. A synthetic-resin screw cap according to claim 1, wherein split grooves are provided at least at a lower end of the attaching cylinder, and a joining strength of the pour-cap main body to the bottle mouth cylinder is set so as to be broken off by hand in a range of not turning free relative to the bottle mouth cylinder.

9. A synthetic-resin screw cap according to claim 1, wherein a locking ridge is provided at a lower end of an inner peripheral surface of the attaching cylinder to be fitted on the bottle mouth cylinder, the locking ridge being locked across the locking circumferential ridge provided around an outer periphery of an opening of the bottle mouth cylinder, and the locking ridge of the attaching cylinder has an intermittent circumferential ridge structure as the means for setting a joining strength of the pour-cap main body to the bottle mouth cylinder.

10. A synthetic-resin screw cap according to claim 1, wherein a spacing into which an end of a hard material such as a coin can be inserted is formed between a lower edge of the attaching cylinder and the neck ring provided at a lower part of an outer peripheral surface of the bottle mouth cylinder.

11. A synthetic-resin screw cap according to claim 1, wherein the pour-cap main body and the outer cap are colored different.

12. A synthetic-resin screw cap according to claim 1, wherein the pour spout formed at the pour-cap main body serving as a pour cap section is a pull-open pour spout opened by breaking and removing an unplug section, which is divided by a breakable groove constructing a closed loop in a sealing wall that is a bottom wall of a pour cylinder provided in order to guide the pouring of a contents liquid.

* * * * *